United States Patent [19]

Nikkel

[11] 4,146,183

[45] Mar. 27, 1979

[54] PRESSED PULP BALE SHREDDER

[75] Inventor: Willem A. Nikkel, Covington, Va.

[73] Assignee: Westvaco Corporation, New York, N.Y.

[21] Appl. No.: 724,693

[22] Filed: Sep. 17, 1976

[51] Int. Cl.[2] ..... B02C 18/04

[52] U.S. Cl. ..... 241/30; 241/152 A; 241/283

[58] Field of Search ..... 241/29, 30, 152 A, 165, 241/164, 190, 243, 281, 283

[56] References Cited

U.S. PATENT DOCUMENTS

| | | | |
|---|---|---|---|
| 3,462,087 | 8/1969 | Butler et al. | 241/190 X |
| 3,472,298 | 10/1969 | Vingradov et al. | 241/283 X |
| 3,661,333 | 5/1972 | Smith | 241/281 |
| 3,709,441 | 1/1973 | Hessner et al. | 241/94 |
| 3,741,051 | 6/1973 | Brooks et al. | 241/283 X |
| 3,804,340 | 4/1974 | Ekman et al. | 241/29 X |
| 3,822,799 | 7/1974 | Evans | 241/29 X |
| 3,923,257 | 12/1975 | Reber | 241/152 AX |

*Primary Examiner*—Howard N. Goldberg
*Attorney, Agent, or Firm*—W. Allen Marcontell; Richard L. Schmalz

[57] ABSTRACT

Bales of wood pulp built from successive wafers of bulk dried pulp may be shredded to small, easily mulched particles by raking a bale face with spaced claws along a plane parallel with the wafer interface. Claws are secured to a power reciprocated bar in pairs with claw points directed along opposite reciprocation directions. The bale is advanced against the traverse plane of the claws in increments coordinated with full reciprocation strokes of the claw bar.

2 Claims, 2 Drawing Figures

PRESSED PULP BALE SHREDDER

BACKGROUND OF THE INVENTION

1. Field Of The Invention

The present invention relates to material comminution methods and apparatus. More particularly, the present invention relates to a method and apparatus for reducing bales of pressed wood pulp to loose fiber.

2. Description Of The Prior Art

Highly defiberized and refined wood pulp has many commercial uses such as for absorbent materials in the fluffed condition and the manufacture of articles in the molded or cast condition.

In the past, such pulp has been predominantly shipped to users in bales of highly compressed sheets manufactured by a basic papermaking process. This process generally comprises the slice flow of an aqueous pulp slurry onto a traveling screen for initial water drainage to consolidate a continuous fiber mat or web. Additional water is removed by roll nip pressing and drum drying. At the dry end of the machine, the web is slit and cut into bale section size sheets which are stacked, pressed and wrapped for shipment.

At the conversion point, sheeted bales may be handled by either of two basic techniques for conversion back to pulp. The sheeted bales may be delaminated for relatively low power comminution in the manner taught by U.S. Pat. Nos. 3,692,246, 3,385,531 or 3,938,746. Alternatively, sheeted bales may be bulk shredded by high power machinery such as is taught by U.S. Pat. No. 3,804,340.

In more recent years, processes and machinery have been developed to fluff-dry pulp thereby eliminating the need for sheet forming and cutting. By this means, dry pulp is transported to a baling apparatus which repeatedly fills and presses a dry, fluffed volume unit of pulp. A succession of such pressed volume units laminately build a bale size compacted unit.

Although there are many economic advantages to fluff drying and press baling pulp in this manner, one disadvantage has been the restrictive limitation to high powered bale shredding equipment at the conversion point. If low powered equipment of the type previously described is used, the bales must first be manually delaminated along the naturally occurring planes of a single compressed volume unit. Consequently, savings won by the pulp manufacturer with a more efficient pulp drying and baling process are lost to the converter is increased labor or capital investment.

It is an object of the present invention, therefore, to provide a low powered apparatus for shredding bulk pressed bales of wood pulp.

SUMMARY OF THE INVENTION

This and other objects of the invention are accomplished by orienting the subject pulp bales relative to the translational plane of a reciprocating claw bar whereby the press planes of the bales are parallel to the translation plane.

In this orientation, the bales are forced into the translational plane in controlled increments. Sequential of each incremental advance of a bale, the claw bar rakes the advancing bale face with a line of claw elements.

Each claw is positioned on the bar frame with an approximately zero angle of rake relative to the translational plane, the claw point and the sole surface of the claw extending from the claw point to the claw heel.

Laterally, each claw is spaced along the line of the bar frame from 2 to 3 inches for a bale advancement increment of ¼ inch.

Parallel with the translational direction of the claw bar, claws are secured to the bar frame in pairs with the points turned to opposite directions. Power is delivered to the bar frame in both directions of a reciprocating work cycle.

BRIEF DESCRIPTION OF THE DRAWING

Relative to the drawing wherein like reference characters designate like or similar elements of the invention throughout the two figures.

DESCRIPTION OF THE PREFERRED EMBODIMENT

Figure 1:
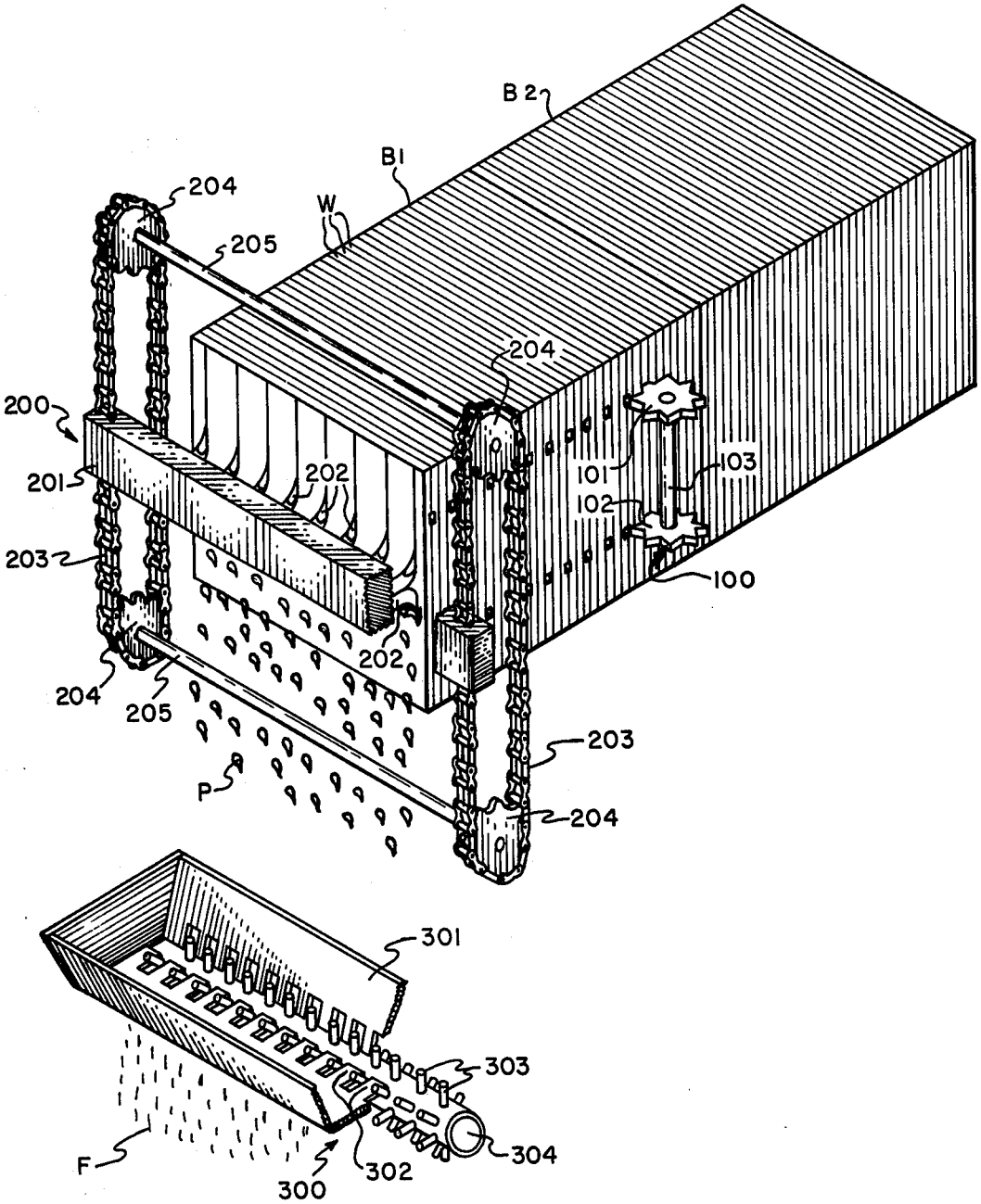
FIG. 1 is an isometric sketch showing the primary mechanical elements and operation of the invention.

Relative to FIG. 1, pressed pulp bales $B_1$ and $B_2$ are formed by a process independent of the present invention which briefly comprises the steps of charging a fixed volume with a substantially uniform quantity of bulk dried wood pulp and pressing the quantity of pulp into a "wafer" or "cookie" W. These steps are repeated with each wafer W being pressed against the face of the previous wafer until the desired size of a bale is accumulated.

Although each wafer W is distinct with random fiber orientation between respective wafer faces, the shear strength between such faces is considerably greater than between individual sheets of machine laid web. Consequently, such wafers are not easily delaminated, each from the other.

In planes perpendicular to the wafer planes, the consolidated strength of a bale is extremely high as provided by a 1500 psi compressive pressure.

Such is the nature of bales $B_1$ and $B_2$ which are fed in a series succession by suitable means such as feed pinions 100 to a shredding plane traversed by the raker claws of a reciprocating device 200.

Coarse particles of pulp P torn from a bale face are directed into a mulching means 300 for further disintegration into fiber sized particles F.

In detail, the bales $B_1$ and $B_2$ are oriented to approach the reciprocation plane of the raker claws with the interfacial planes of the pulp wafers W parallel to the reciprocation plane. A matched set of feed pinions comprising cogs 101 and 102 mounted on a common shaft 103 are positioned on both sides of the bale $B_1$ at positions lateral of the bale sides so that the cog teeth will penetrate the bale for a positive grasp of the bale.

The drive for the feed pinions 100, not shown is drawn from a primary power source and coordinated with the reciprocating device 200 to advance the bale $B_1$ into the reciprocation plane by a desired increment, ¼ inch (0.635 cm) for example, with each reciprocation stroke.

Reciprocating device 200 comprises a raker bar 201 having claws 202 secured thereto. The claws 202 are positioned back-to-back in pairs spaced approximately 2 to 3 inches (5 to 7.6 cm) apart. Opposite ends of the raker bar 201 are secured to link chains 203. Not shown but preferably provided are guide means to secure the raker bar 201 translational plane and prevent torque movements about the longitudinal axis of the bar.

Chains 203 are wrapped about respective sprocket pairs 204 which are rotatively secured together by shafts 205.

Power is delivered to the chain sprockets 204 through any suitable direction reversing mechanism not shown so that when the claws 202 have raked the face of the bale $B_1$ in one direction, rotation of the drive shaft 205 will reverse to drive the raker bar 201 back in the opposite direction.

A suitable alternative raker bar drive may include a double acting hydraulic cylinder arrangement.

At the end of a reciprocation stroke, the feed pinions 100 are rotated by an arc portion to advance the bale $B_1$ by the desired amount into the translational plane raked by the points of claws 202.

The mulching mechanism 300 which receives the rough shredded pulp particles P comprises a hopper trough 301 which funnels the particles P onto stator tines 302. Rotor tines 303 secured to a rotatively driven drum 304 stroke the particles P at high velocity, driving them between adjacent stator tines 302 to shatter the particles P into fibers F.

Figure 2:
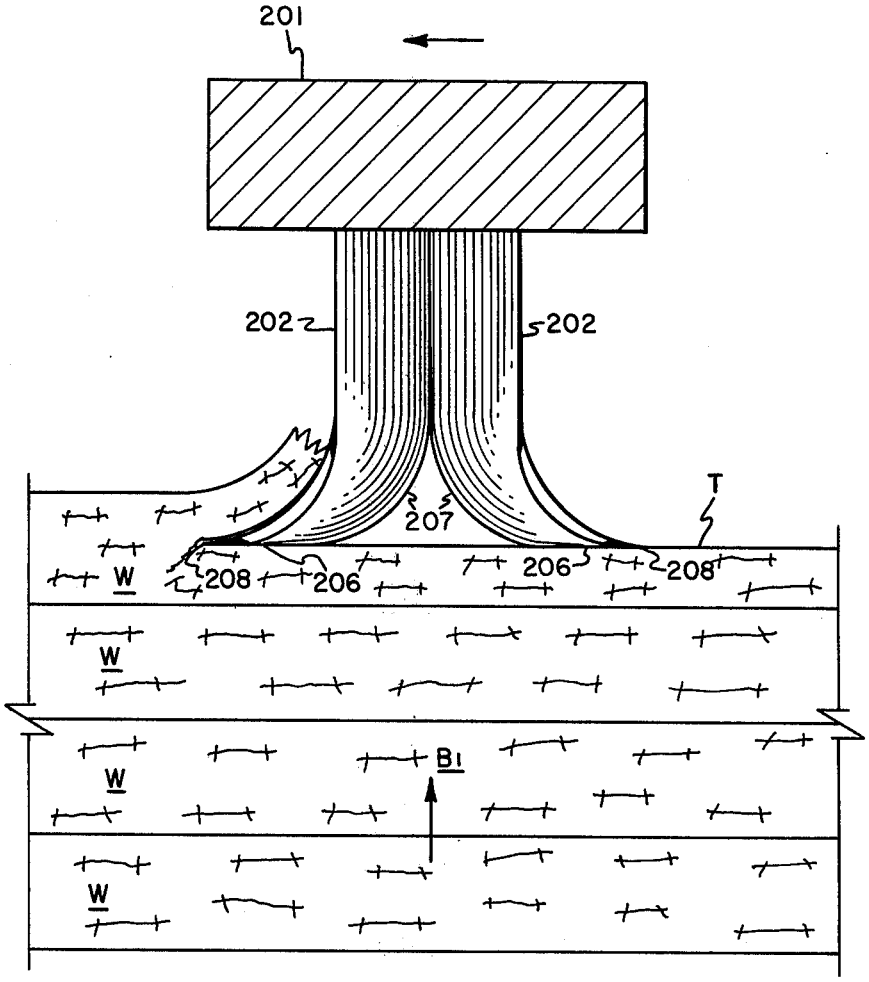
FIG. 2 is an enlarged detail of the claw bar portion of the invention.

The detailed enlargement of FIG. 2 shows the nature of the shredding action of claws 202 on the pulp bale $B_1$. It should first be noted that the translation plane T of the claw points 208 does not necessarily coincide with the interfacial planes between wafers W. Accordingly feed rate increments of the feed pinion mechanism 100 need not be related to the depth of such wafers W. Due to the pulp pressing action, it is likely that most individual fibers within the bale B are longitudinally aligned with wafer planes. Accordingly few fibers are length aligned perpendicular to the wafer planes thereby lending little strength to the bale composition in that direction. Consequently the claws 202 may plow along the center of a wafer section almost as easily as long the interface between wafers W.

An additional note of interest to the disposition of claws 202 concerns the angle of the claw shoe surface 206 between the point 208 and the heel 207. To minimize the power requirements, this shoe surface 206 should approach the point 208 in approximate tangency (0 degrees) with the surface of the translational plane T. An angular approach of the shoe surface 206 to the point 208 from either side of the plane T will cause the point to either dig for greater depth or plane away from the bale. Either result is undesirable due to the resulting unproductive expenditure of energy.

In a specific design example, a 15 in. × 30 in. × 36 in. pressed pulp bale layered in planes parallel with the 30 in. × 36 in. edge plane was shredded with a raker bar apparatus such as that disclosed. Lateral claw spacing was 3 in. along the 36 in. face dimension. Advancement velocity of the raker bar 201 along the 30 in. face dimension was 40 fpm over a 48 in. stroke and against a ¼ inch bale thickness increment. This arrangement shredded 310 lb., 33 lb./ft.$^3$ bales with 60 strokes in 6 minutes and consumed 3 HP in the process. The entire apparatus including raker bar drive, bale in-feed mechanism, and mulching apparatus drive consumed 7.5 HP.

Having fully disclosed my invention,

I claim:

1. An apparatus for shredding bales of wood pulp having a multiplicity of planar layers, each layer of each bale having two distinct perpendicular face edges in a respective layer plane and comprising a unit volume of randomly oriented, bulk dried pulp compacted upon a previously compacted layer, said apparatus comprising:

A. A plurality of laterally spaced oppositely directed claw means secured to rigid bar means by a heel portion for reciprocation parallel with a traverse plane, surface elements of said claw means converging three-dimensionally about a curved axis to a point in said traverse plane, the convergence of such surface elements most proximate of said traverse plane following a locus of decreasing included angle with said traverse plane from said heel portion of said claw means to substantial tangency with said traverse plane prior to said point and continuing parallel therewith to said point;

B. Cyclically reciprocating power means secured to said bar means to stroke said claw means simultaneously along opposite half cycle reciprocation paths in said traverse plane, planes of said included angles being set in parallel alignment with said reciprocation path, each half cycle reciprocation stroke of said power means exceeding one face edge dimension of said bale; and C. Bale feeding means for engaging a pulp bale and incrementally advancing the plane of said layers into said traverse plane and parallel therewith, the advancement increments of said feed means being coordinated between bale engaging strokes of said claw means.

2. A method for shredding bales of wood pulp having a multiplicity of planar layers, each layer of each bale having two distinct perpendicular face edges in a respective layer plane and comprising a unit volume of randomly oriented, bulk dried pulp compacted upon a previously compacted layer, the shredding method comprising the steps of:

A. Cyclically reciprocating a plurality of laterally spaced claw elements in opposite linear directions within a traverse plane, said claw elements being secured to rigid bar means by a heel portion, the surface of such claw elements converging three-dimensionally about a curved axis to a point in said traverse plane, the convergence of such surface elements most proximate of said traverse plane following a locus of decreasing included angle with said traverse plane from said heel portion to substantial tangency with said traverse plane prior to said point and continuing parallel therewith to said point;

B. Stroking said claw elements over a dimension exceeding one face edge of said bale;

C. Orienting the planar layers of said bale parallel with said traverse plane and said one face edge parallel with said opposite directions; and, D. Advancing a layer face of said oriented bale along a direction perpendicular to said traverse plane by increments sequenced between successive strokes of a reciprocation cycle whereby said claw points pierce said pulp along a direction parallel with said traverse plane to lift outer, face portions of said pulp by tensile separation from the remainder of said bale.

* * * * *